United States Patent [19]

Sugiura et al.

[11] 3,968,956

[45] July 13, 1976

[54] LANCING APPARATUS WITH MEANS FOR READY REPLACEMENT OR RENEWAL OF LANCES FOR TOP BLOWN METALLURGICAL FURNACES

[75] Inventors: Junsuke Sugiura, Iwaki; Junetsu Takahashi, Kagawa; Takeyoshi Shibasaki; Motoaki Yoneda, both of Iwaki, all of Japan

[73] Assignee: Mitsubishi Kinzoku Kogyo Kabushiki Kaisha, Tokyo, Japan

[22] Filed: Nov. 14, 1974

[21] Appl. No.: 523,877

[52] U.S. Cl. ..... 266/226; 285/111

[51] Int. Cl.[2] ..... C21C 5/32

[58] Field of Search ..... 266/34 L, 34 LM; 285/111, 112

[56] References Cited

UNITED STATES PATENTS

| | | | |
|---|---|---|---|
| 2,210,826 | 8/1940 | Williams | 285/111 |
| 2,231,878 | 2/1941 | Boynton | 285/111 |
| 2,467,036 | 4/1949 | Iftiger | 285/112 |
| 3,170,977 | 2/1965 | Oberchair | 266/34 LM |
| 3,447,819 | 6/1969 | Borsum et al. | 285/111 |
| 3,456,963 | 7/1969 | Dillon | 285/112 |

FOREIGN PATENTS OR APPLICATIONS

| | | | |
|---|---|---|---|
| 221,124 | 10/1961 | Austria | 266/34 L |

*Primary Examiner*—Gerald A. Dost
*Attorney, Agent, or Firm*—Wenderoth, Lind & Ponack

[57] ABSTRACT

For detachably holding a lance in axial alignment with the mouth or top opening of a metallurgical furnace, use is made of a chuck through which the lance can be inserted upwardly for communication with an outlet conduit extending downwardly from a vessel defining a pressure-tight air or oxygen chamber therein. A packing box supported under the outlet conduit houses means for establishing pressure-tight communication between the lance and the outlet conduit. The vessel, the packing box and the chuck are all bracketed to a carriage movable along a vertical track for causing up-and-down motion of the lance into and out of the furnace mouth. According to another embodiment of the invention, means are further provided for rotating the lance while the latter is inserted into the furnace.

5 Claims, 4 Drawing Figures

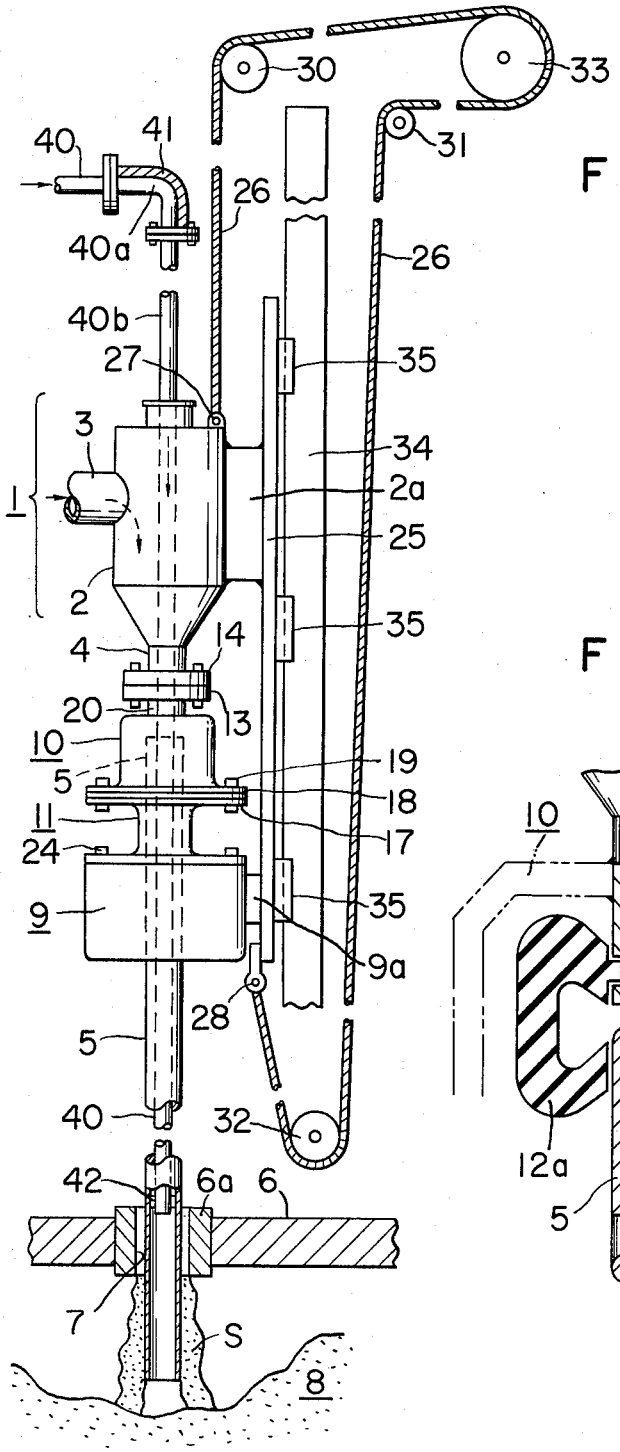
FIG. 1
FIG. 3
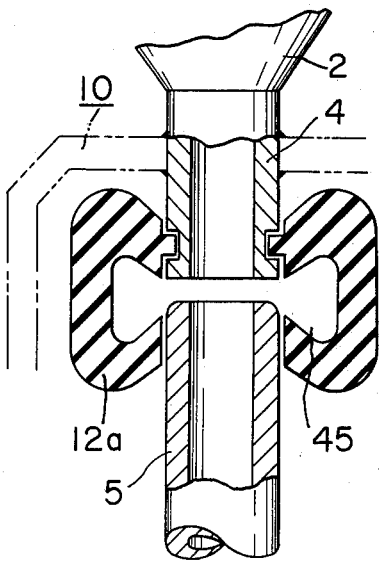

LANCING APPARATUS WITH MEANS FOR READY REPLACEMENT OR RENEWAL OF LANCES FOR TOP BLOWN METALLURGICAL FURNACES

BACKGROUND OF THE INVENTION

This invention relates generally to metallurgical furnaces and more specifically to what is herein termed a lancing apparatus for blowing air or oxygen into a top-blown metallurgical furnace, such as in the basic oxygen steelmaking process, through a lance or pipe inserted therein through its mouth. Even more specifically, the invention is directed to means for facilitating the replacement or renewal of the lance as the same is consumed by fusion and/or corrosion within the furnace.

As is well known, the desired metallurgical reactions within the furnace under consideration are carried out at such high temperatures that a lance inserted therein inevitably suffers gradual fusion from its tip, even if the lance is made of metal having a high melting point and further specially treated for affording corrosion resistance at high temperatures. As the lance is consumed, that is, shortens to a certain specifiable point, by the progress of the gradual fusion, the same is detached from the lancing apparatus holding its top end, either in situ or after having been withdrawn out of the furnace. A new lance is then inserted into the apparatus, and the top end of the consumed lance is screw-threadedly or otherwise jointed to the bottom end of the new lance. The thus-renewed lance is again inserted into the furnace for recommencement of the oxygen lancing operation.

Thus, where a number of lances are required, as for use in large smelting furnaces operating at extremely high temperatures, the renewal of the consumed lances can be effected only at the expense of substantial time and labor. What is worse, prolonged downtime must be imposed upon the furnaces, resulting in a significant decrease in their production rates.

SUMMARY OF THE INVENTION

It is, therefore, among the objects of this invention, to provide a lancing apparatus including means designed specifically to facilitate the replacement or renewal of consumed lances, thereby contributing toward the increase in furnace productivity.

Another object of the invention is to provide a lancing apparatus such that each new lance is readily connectable in position therein and, when shortened to a predetermined length by fusion, is readily detachable therefrom.

A further object of the invention is to provide a lancing apparatus such that each new lance connected thereto can be automatically pressure-tightly communicated with a source of air or oxygen under pressure.

A further object of the invention is to provide a lancing apparatus including means for moving the lance up and down in exact axial alignment with the mouth or top opening of the furnace.

A still further object of the invention is to provide a lancing apparatus integrally incorporating means for imparting rotation to the lance while the latter is inserted into the furnace, thereby effectively preventing the formation of the skulls which would clog the furnace mouth during the lancing operation.

Briefly, the invention provides an apparatus including a vessel defining a pressure-tight air or oxygen chamber therein. A packing box is supported coaxially under the outlet conduit of the vessel extending downwardly therefrom, and a chuck is further supported coaxially under the packing box to permit a lance to be inserted upwardly therethrough into the packing box and to releasably hold the lance in axial alignment with the mouth of the furnace with which the apparatus is adapted for use. The packing box houses means effective to establish the pressure-tight communication of the lance with the vessel via the outlet conduit. The vessel, the packing box and the chuck are together supported on a carriage movable along a vertical track, and as the carriage is driven up and down along the track, the lance is moved into and out of the furnace as desired.

Preferably, a guide sleeve should be arranged coaxially between the packing box and the chuck so that the lance inserted into the chuck may be guided properly up into the packing box.

According to a further feature of the invention, the outlet conduit is rotatably supported relative to the vessel, and the packing box and the chuck are fixedly connected to the vessel so as to be rotatable with the outlet conduit. A rotary actuating mechanism, such as an electric motor, is supported within the vessel and imparts rotation to the outlet conduit and hence to the packing box and the chuck, so that the lance held by the chuck can be rotated within the furnace to prevent any excessive growth of skulls resulting from the lancing operation.

The features which are believed to be novel and characteristic of this invention are set forth in particular in the claims appended hereto. The invention itself, however, both as to its organization and mode of operation, together with the further objects and advantages thereof, will become apparent in the course of the following detailed description, when read in connection with the accompanying drawings in which some preferable embodiments of the invention are disclosed, and in which like reference characters denote like parts throughout the several views.

BRIEF DESCRIPTION OF THE DRAWINGS

In the drawings:

FIG. 1 is a side elevational view, partly broken away and partly in vertical section, of the lancing apparatus constructed in accordance with the novel concepts of this invention;

FIG. 3 is a partial axial sectional view of a modified form of packing means in the apparatus shown in FIGS. 1 and 2.

DETAILED DESCRIPTION

Figure 2:
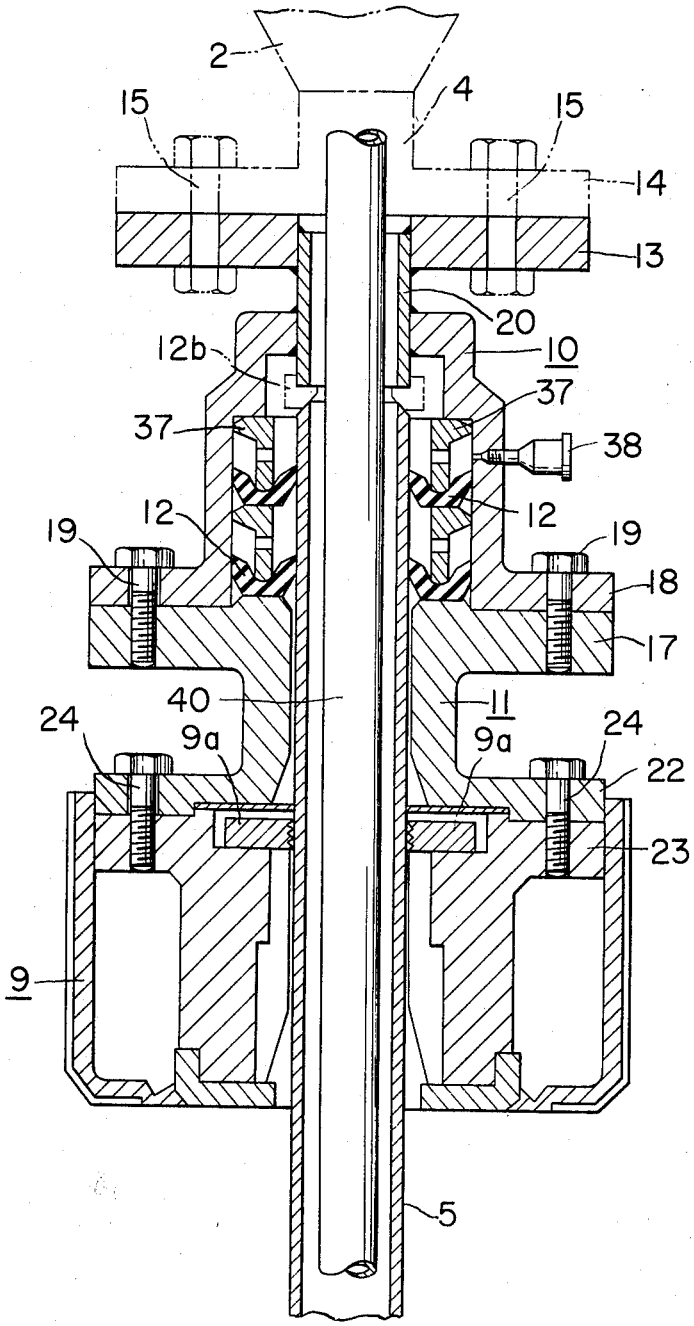
FIG. 2 is an enlarged axial sectional view of some essential components in the apparatus shown in FIG. 1.

FIG. 1 best illustrates the general organization of a preferred form of the lancing apparatus according to this invention. A header 1 includes a vessel or shell 2 of cylindrical shape defining a pressure-tight air or oxygen chamber therein. An inlet conduit 3 is connected to the vessel 2 to introduce into the latter air or oxygen under pressure from a suitable source of such gas, not shown. The lower end portion of the vessel 2 tapers or funnels into an outlet conduit 4.

A pipe 5 known in the art as a lance is communicated, at its one end, with the pressure-tight chamber within the vessel 2 via the outlet conduit 4, as later described in more detail. The lance 5 at its other end is inserted into a furnace through its mouth 7 bounded as by a graphite sleeve 6*a* in the furnace top 6 which may be made of bricks. The air or oxygen that has been supplied under pressure into the vessel 2 is thus directed downwardly through the lance 5 onto the bath or the body of molten metal 8 within the furnace.

The lancing apparatus according to the invention further broadly comprises a chuck 9 for rigidly but releasably holding the lance 5 in a position of axial alignment with the vessel 2 and the furnace mouth 7, and a packing or stuffing box 10 arranged between the vessel 2 and the chuck 9. Preferably, a guide sleeve 11 should be installed between the chuck 9 and the packing box 10 for guiding into the latter the top end of the lance 5 as the same is inserted upwardly into the chuck.

FIG. 2 illustrates the structural details of the chuck 9 and the packing box 10, as well as their relationships with other associated parts. The packing box 10, housing one or more (two in the illustrated embodiment) annular packing members 12 of rubber or like elastic material with a substantially U-shaped cross section, has a tubular neck 20 terminating at its upper end in a flange 13 and welded thereto, which flange 13 is bolted at 15 to another flange 14 at the lower end of the outlet conduit 4. The vessel 2 is thus arranged in axial alignment with the packing box 10 via the outlet conduit 4 and the neck 20. This neck may, in one form of construction, be constituted of a tubular member which is welded or otherwise integrally joined both to the packing box 10 and to a centrally apertured disc functioning as the flange 13.

The packing box 10 has at its bottom end another flange 18 which is bolted at 19 to a flange 17 at the top end of the guide sleeve 11. The guide sleeve also has a bottom flange 22 which is bolted at 24 to a top flange 23 of the chuck 9. It will be observed from a consideration of FIG. 2 that the packing box 10, the guide sleeve 11 and the chuck 9 are all axially aligned with each other and therefore with the vessel 2.

Referring again to FIG. 1, the assembly comprising the vessel 2, the packing box 10, the guide sleeve 11, and the chuck 9 is supported by a vertical carriage 25 through a bracket 2*a* interconnecting the vessel and the carriage and another bracket 9*d* rigidly interconnecting the chuck and the carriage. In order to impart up-and-down motion to the aforesaid assembly and hence to the lance 5 relative to the furnace, there is provided drive means including a cable 26 which is fastened at one end 27 to the top of the vessel 2 and at the other end 28 to the bottom end of the carriage 25. The cable 26 extends over idler or guide pulleys 30, 31 and 32 and a drive pulley 33. The carriage 25 has a plurality of vertically aligned shoes 35 adapted to ride over a vertical track 34. Hence, by rotating the drive pulley 33 by a suitable actuating mechanism, not shown, all parts or components supported by the carriage 25 are moved up and down relative to the furnace.

Alternatively, the drive means for imparting up and down motion to the assembly may comprise a conventional winch operated by an electric motor or a manually operable chain block. In this case, the cable 26 can be secured to only the upper end 27 of the assembly.

The assembly can be lowered by gravity when the cable is slackened.

As illustrated in FIG. 2, the chuck 9 includes gripping jaws 9*a* which are movable in any convenient manner to permit, when in the "open" position, the lance 5 to pass therethrough until the latter is fully inserted upward into the packing box 10 via the guide sleeve 11. Upon closure of the gripping jaws the lance can be securely supported in position in open communication with the vessel 2 via the neck 20 and the outlet conduit 4. It is noteworthy that the chuck for use in the apparatus of this invention can be of any suitable construction known as such, including those whose jaws are operated either by a scroll, by screws, or by compressed air or hydrauliic fluid.

The lance 5 inserted upwardly into the packing box 10 as above stated is forced through the annular packing members 12 supported therein in a vertically spaced, coaxial relationship by retainers 37. The circumferential edges of these packing members are resiliently pressed against the internal surface of the packing box 10, and since their inside edges are likewise resiliently urged against the lance 5 as the latter is forced upwardly therethrough, it will be seen that the packing members 12 effectively function as sealing means preventing the leakage of the air or oxygen under pressure from between the outlet conduit 4 of the vessel 2 and the lance 5.

If desired, the packing box 10 can be equipped with a grease cup 38 or the like to lubricate the contacting surfaces of the lance 5 and the packing members 12 and hence to minimize the wear of the latter. It is also possible in this manner to form air- or gas-tight grease films between the circumferences of the packing members 12 and the internal surface of the packing box 10. Notwithstanding the showing of FIG. 2, the packing member or members to be housed in the packing box 10 are not necessarily of U- or V-shaped cross section, as other types of packings can be employed in accordance with the broad teachings of this invention.

Although not an essential feature of the lancing apparatus according to this invention, piping 40 best illustrated in FIG. 1 is adapted to charge into the furnace such materials as granulated or pulverized ore or flux which is necessary for or is to be treated in a desired metallurgical process therein. The piping 40 includes a pipe 40*a* which is bent at right angles and is externally lined with suitable wear-resistant material in consideration of the possible premature wear of that pipe from frictional contact of the materials passing therethrough. The piping 40 further includes a straight pipe 40*b* extending axially through the vessel 2 and the lance 5 and terminating short of the bottom end of the latter. The piping 40 extends upwardly through and beyond the vessel in an air-tight and slidable manner and is fixed in position, so that the lancing assembly moves vertically relative to the piping. A spacer 42 may be provided between the bottom end portion of the pipe 40*b* and the lance 5. This construction permits the materials to be charged into the furnace while at the same time the air or oxygen is being introduced therein.

FIG. 3 illustrates an alternative form of the internal construction of the packing box 10. As shown, the annular packing members 12 with their retainers 37 of the preceding example are here replaced by a victoric-joint-type annular packing member 12*a* having a substantially recumbent U-shaped cross section. This packing member is also made of rubber or like elastic material and is fitted over the bottom end of the outlet conduit 4 of the vessel 2 projecting into the packing box 10, thereby permitting the lance 5 to be jointed to the outlet conduit substantially in a bell-and-spigot fashion.

According to the arrangement shown in FIG. 3, the internal space 45 of the packing member 12*a* expands as the air or oxygen is delivered under pressure from the outlet conduit 4 into the lance 5, with the result that the inside edges of the packing member become urged against the internal surfaces of the outlet conduit and the lance, respectively. The joint between the outlet conduit and the lance can thus be definitely sealed against leakage of the air or oxygen under pressure.

It is possible to use a more simplified substitute for the packing member 12 or 12*a*. For instance, a ring 12*b* of rubber or the like may be affixed to the bottom end of the outlet conduit 4 or the tubular neck 20, as indicated by the dot-and-dash lines in FIG. 2. The inside diameter of this ring is made suitably smaller than the outside diameter of the outlet conduit 4 or the tubular neck 20 and of the lance 5, so that the top end of the lance which has been fully inserted into the packing box 10 will press the ring against the bottom end of the outlet conduit or the tubular neck. The ring 12*b* thus held in a state of compression between the outlet conduit or tubular neck and the lance will effectively seal the joint.

In the operation of the lancing apparatus hereinbefore described with reference to FIGS. 1 to 3, the lance 5 supported by the chuck 9 in open communication with the vessel 2 is vertically movable into and out of the furnace mouth 7 as the drive pulley 33 is rotated in either direction. The height of the lance can be suitably adjusted so that its bottom end will be held in an optimum position within the furnace. The air or oxygen blown under pressure by the lance 5 may splash the bath 8 within the furnace, resulting in the formation of the skulls S tending to clog the spacing between the lance and the graphite sleeve 6*a* bounding the furnace mouth 7. This possibility can be precluded by imparting vertical vibratory motion or rotary motion to the lance.

The metallurgical process taking place within the furnace proceeds at such high temperatures that the lance 5 inevitably suffers gradual fusion from its bottom end. When the fusion of the lance has progressed to a point where no further descent thereof into the furnace is possible, the gripping jaws 9*a* of the chuck 9 should be operated to release the consumed lance. This lance can be withdrawn out of the chuck as the complete assembly mounted on the carriage 25 is succeedingly elevated away from the furnace. A new lance may now be inserted into the chuck 9 until its top end portion is properly received in the packing box 10 via the guide sleeve 11, and the top end of the old lance is then welded or screw-fastened to the bottom end of the new lance so that the axes of the two lances may be in line. The introduction of the air or oxygen into the furnace can now be recommenced. During the above stated operation, the piping 40 may be separated from its bent portion 40*a* at the flanged part and moved upwardly with the lancing assembly. At this time, the operator or operators must move away from the lancing apparatus.

Figure 4:
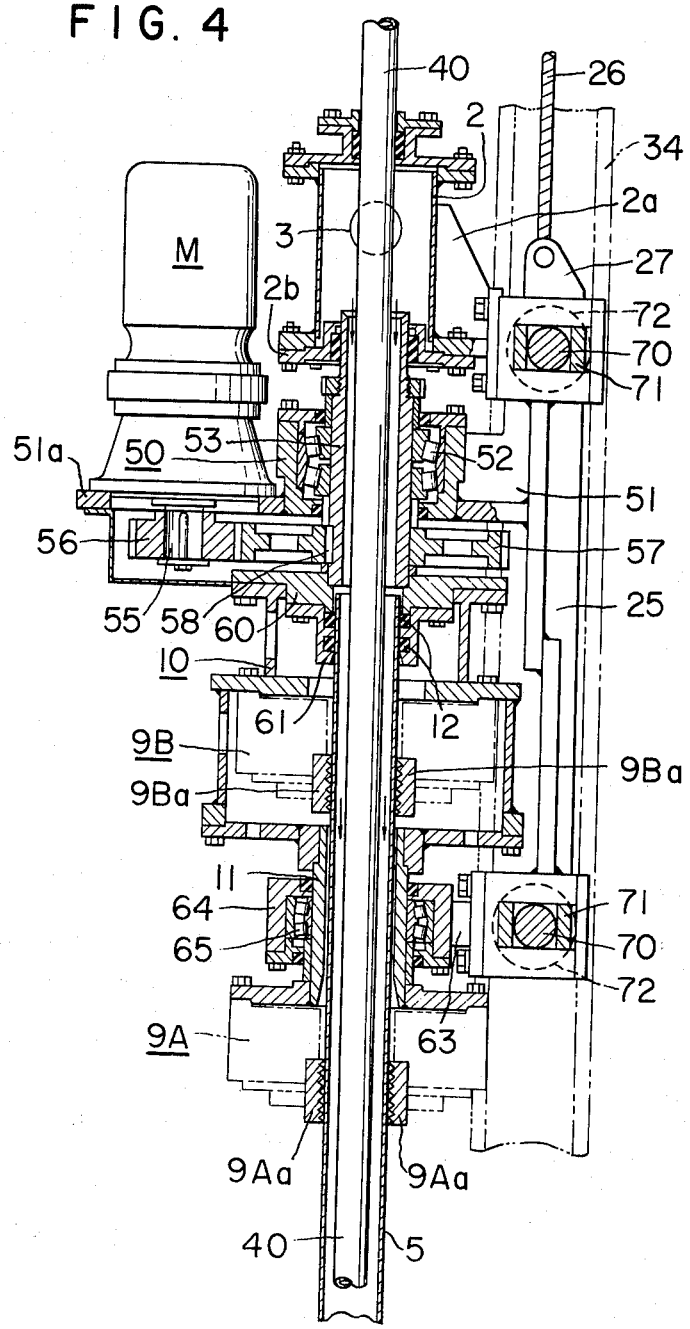
FIG. 4 is an axial sectional view, partly in side elevation, of another preferred embodiment of the invention.

FIG. 4 illustrates another preferred embodiment of the invention which differs from the preceding embodiment in that the lance is rotated around its longitudinal axis during its operation and that two chucks are provided for gripping the lance. In this figure, the same reference characters as are used in FIGS. 1 to 3 designate the same or corresponding parts.

In this example, a vessel 2 is provided with an inlet conduit 3 for introducing air or oxygen therein and is fixedly supported on a carriage 25 by a bracket 2*a*.

Directly below the vessel 2 there is provided a bearing assembly 50 rigidly supported by the carriage 25 through a bracket 51. The bearing assembly 50 contains therein a roller bearing 52 in which an air outlet conduit in the form of a vertical hollow shaft 53 is rotatably supported. The upper end of the shaft 53 passes upwardly through the bottom wall 2*b* of the vessel 2 in an air-tight manner.

The bracket 51 has an extension 51*a* on which a rotary actuating mechanism such as a motor M is fixedly mounted. The motor M has an output shaft 55 on which is fixedly mounted a drive gear 56 meshing with a driven gear 57. The driven gear 57 is fixedly mounted on the hollow shaft 53 by means of a key 58 and is rotatable with the hollow shaft 53.

A packing box 10 has a top cover 60 fixedly connected to the lower end of the hollow shaft 53. The top cover 60 fixedly carries thereunder a cup-shaped packing retaining member 61 in which annular packing members 12 are disposed. These packing members 12 engage the outer surface of the lance 5 as in the previous embodiment.

The packing box 10 carries thereunder a chuck 9B which may be a well-known scroll chuck and has gripping jaws 9B*a* for gripping the lance 5. The chuck 9B is operated from outside by any suitable means. It will be noted that the chuck 9B is rotatable with the hollow shaft 53.

To the lower end of the carriage 25 is rigidly secured a bracket 63 on which is fixed a bearing assembly 64. The bearing assembly 64 has a roller bearing 65 therein in which a guide sleeve 11 is rotatably supported. The sleeve 11 is fixed to the bottom of the chuck 9B and is rotatable with the chuck.

The lower end of the sleeve 11 is fixedly connected to a second chuck 9A having jaws 9A*a* for gripping the lance. This chuck 9A may also be a scroll chuck.

The carriage 25 has at its upper and lower ends stationary shafts 70 which are adjustable in their horizontal positions relative to the carriage 25 by means of shims 71. The shafts 70 support on their free ends rollers 72, respectively, which are rotatable around the respective shafts 70 and roll along and in a guide track 34 having a U-shaped cross section.

The piping 40 extends down through the vessel 2 in an airtight and relatively slidable manner, the hollow shaft 53, and the lance 5, as in the previous embodiment, to supply ore into the furnace.

In operation, air or oxygen is supplied into the vessel 2 and flows down through the hollow shaft 53 and the lance 5. In this case, air or oxygen is prevented from escaping outside because of the sealing contact between the lance 5 and the packing member 12 and between the hollow shaft 53 and the bottom wall 2*b* of the vessel 2.

In this embodiment, the motor M is operated during the operation of the apparatus. The rotation of the motor output shaft 55 and hence the driving gear 56 causes rotation of the vertical hollow shaft 53, which in turn causes rotation of the packing box 10, the chuck 9B, the guide sleeve 11, and the chuck 9A. In this case, if the chucks 9A and 9B are operated to grip the lance 5, the lance is also rotated around its longitudinal axis.

The rotation of the lance 5 effectively prevents the formation of the skulls within the furnace which might fill up the spacing between the lance and the graphite sleeve 6*a* bounding the furnace mouth, as will be understood by referring back to FIG. 1. The possibility of the furnace, particularly its mouth region, being damaged is obviated as a result of the forced removal of the skulls. It will be seen that relative rotation between the lance 5 and the members surrounding and engaging it does not occur in any event since all of these members rotate with the lance 5.

The lancing apparatus shown in FIG. 4 is particularly advantageous in that it compactly combines the means for vertically movably supporting the lance and the means for imparting rotation thereto. As an additional advantage, the lance can be rotated relative to the furnace in a stable manner since the lance is rotatably supported in position both by the two chucks and by the guide sleeve 11.

What is claimed is:

1. An apparatus for blowing air or oxygen under pressure into a metallurgical furnace through a lance inserted therein through its mouth, said apparatus comprising:

a vessel defining a pressure-tight air or oxygen chamber therein and having an inlet conduit and an outlet conduit communicating with said pressure-tight chamber, said outlet conduit extending downwardly from said vessel;

a packing box rotatably supported coaxially under said outlet conduit of said vessel in open communication therewith;

a chuck supported coaxially under said packing box and adapted to permit the lance to be inserted upwardly therethrough into said packing box, said chuck being rotatably supported and including means for releasably holding the lance in axial alignment with the mouth of the furnace located below said chuck;

packing means within said packing box for effectively establishing pressure-tight communication between said outlet conduit of said vessel and the lance, said packing means being adapted for sealing contact with the lance;

a carriage movable vertically and combinedly supporting said vessel, said packing box, and said chuck thereon;

first drive means for imparting up-and-down motion to said vessel, said packing box, and said chuck toward and away from the furnace; and second drive means for imparting rotation to said packing box and said chuck.

2. An apparatus as claimed in claim 1, further comprising guide means arranged coaxially below said chuck to permit the lance to be inserted accurately into said packing box through said chuck.

3. An apparatus as claimed in claim 2, further comprising a second chuck coaxially arranged below said guide means and being rotatable with the first mentioned chuck.

4. An apparatus as claimed in claim 1, wherein said second drive means comprises a rotary actuating mechanism carried by said carriage, and gearing adapted to transmit rotation of said rotary actuating packing box, first chuck, guide sleeve, and second chuck.

5. An apparatus as claimed in claim 1, further comprising stationary piping means extending through said vessel and lance coaxially therewith in an airtight and slidable manner relative to said vessel for feeding therethrough granulated or pulverized ore or flux into the furnace.

* * * * *

UNITED STATES PATENT OFFICE
CERTIFICATE OF CORRECTION

Patent No. 3,968,956 Dated July 13, 1976

Inventor(s) JUNSUKE SUGIURA ET AL.

It is certified that error appears in the above-identified patent and that said Letters Patent are hereby corrected as shown below:

In the heading of the patent, No. "[73]" should read as follows:

--[73] Assignee: MITSUBISHI KINZOKU KABUSHIKI KAISHA, Tokyo-To, Japan--

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*